US010816927B2

(12) United States Patent
Naganuma et al.

(10) Patent No.: US 10,816,927 B2
(45) Date of Patent: Oct. 27, 2020

(54) TRANSPORT DEVICE AND IMAGE FORMING APPARATUS

(71) Applicant: FUJI XEROX CO., LTD., Tokyo (JP)

(72) Inventors: Teruki Naganuma, Kanagawa (JP); Junichi Asaoka, Kanagawa (JP); Mizuki Arai, Kanagawa (JP); Akira Iwasaka, Kanagawa (JP); Yuki Sekura, Kanagawa (JP); Kohei Takahashi, Kanagawa (JP); Hiromitsu Tomioka, Kanagawa (JP); Keita Yano, Kanagawa (JP); Yuichiro Shimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/282,324

(22) Filed: Feb. 22, 2019

(65) Prior Publication Data

US 2020/0089153 A1 Mar. 19, 2020

(30) Foreign Application Priority Data

Sep. 14, 2018 (JP) ..... 2018-172232

(51) Int. Cl.

| | |
|---|---|
| ***B65H 5/06*** | (2006.01) |
| ***G03G 15/00*** | (2006.01) |
| ***B65H 29/12*** | (2006.01) |

(52) U.S. Cl.

CPC ..... *G03G 15/6529* (2013.01); *B65H 5/062* (2013.01); *B65H 29/12* (2013.01); *B65H 2511/224* (2013.01)

(58) Field of Classification Search

CPC ..... B65H 5/062; B65H 2404/143; B65H 2404/1431; B65H 2404/144; B65H 2404/1441; B65H 2511/224; B65H 29/12

See application file for complete search history.

(56) References Cited

U.S. PATENT DOCUMENTS 8,876,111 B1 * 11/2014 Lan ..... B65H 5/06 271/273
2009/0060609 A1 * 3/2009 Watanabe ..... G03G 15/6567 399/395

FOREIGN PATENT DOCUMENTS

| | | | |
|---|---|---|---|
| JP | 05155470 A | * | 6/1993 |
| JP | 2005314011 | | 11/2005 |
| JP | 2010066735 A | * | 3/2010 |
| JP | 2017057037 A | * | 3/2017 |
| JP | 2018070305 A | * | 5/2018 |

* cited by examiner

*Primary Examiner* — Luis A Gonzalez
(74) *Attorney, Agent, or Firm* — JCIPRNET

(57) ABSTRACT

A transport device includes a first rotary part that rotates; a second rotary part that contacts the first rotary part, that forms a pinch region where an object to be transported is pinched between the second rotary part and the first rotary part, and that rotates together with the first rotary part; and a positioning mechanism that positions the second rotary part with respect to the first rotary part. The positioning mechanism includes a swing part that supports one end portion side of the second rotary part, that is supported at one end portion side of the first rotary part, and that is swingable around a rotation center of the first rotary part; and a fixing section that fixes the swing part.

8 Claims, 6 Drawing Sheets

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2018-172232 filed Sep. 14, 2018.

BACKGROUND

(i) Technical Field

The present disclosure relates to a transport device and an image forming apparatus.

(ii) Related Art

Japanese Unexamined Patent Application Publication No. 2005-314011 describes a sheet transport device in which a transport roller pair including a driving roller and a driven roller that contacts the driving roller with a pressure pinches and transports a sheet. The sheet transport device includes a changing section that changes a sheet transport direction of the transport roller pair, and an adjusting section that adjusts a change amount of the sheet transport direction by the changing section through an operation from a side surface of a device body. An operation amount of the adjusting section for changing the sheet transport direction of the transport roller pair is proportional to the change amount of the sheet transport direction by the changing section.

SUMMARY

When an object to be transported is pinched in a pinch region that is formed because a first rotary part contacts a second rotary part and the object to be transported is transported, if the positioning accuracy of the first rotary part and the second rotary part is low, the object to be transported may be skewed.

Aspects of non-limiting embodiments of the present disclosure relate to a transport device and an image forming apparatus including a swing part that supports one end portion side of a second rotary part and that is supported at one end portion side of a first rotary part, the swing part being swingable around a rotation center of the first rotary part, thereby accurately positioning the second rotary part with respect to the first rotary part, as compared with a configuration without the swing part.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport device including a first rotary part that rotates; a second rotary part that contacts the first rotary part, that forms a pinch region where an object to be transported is pinched between the second rotary part and the first rotary part, and that rotates together with the first rotary part; and a positioning mechanism that positions the second rotary part with respect to the first rotary part. The positioning mechanism includes a swing part that supports one end portion side of the second rotary part, that is supported at one end portion side of the first rotary part, and that is swingable around a rotation center of the first rotary part; and a fixing section that fixes the swing part.

BRIEF DESCRIPTION OF THE DRAWINGS

An exemplary embodiment of the present disclosure will be described in detail based on the following figures, wherein.

DETAILED DESCRIPTION

Figure 1:
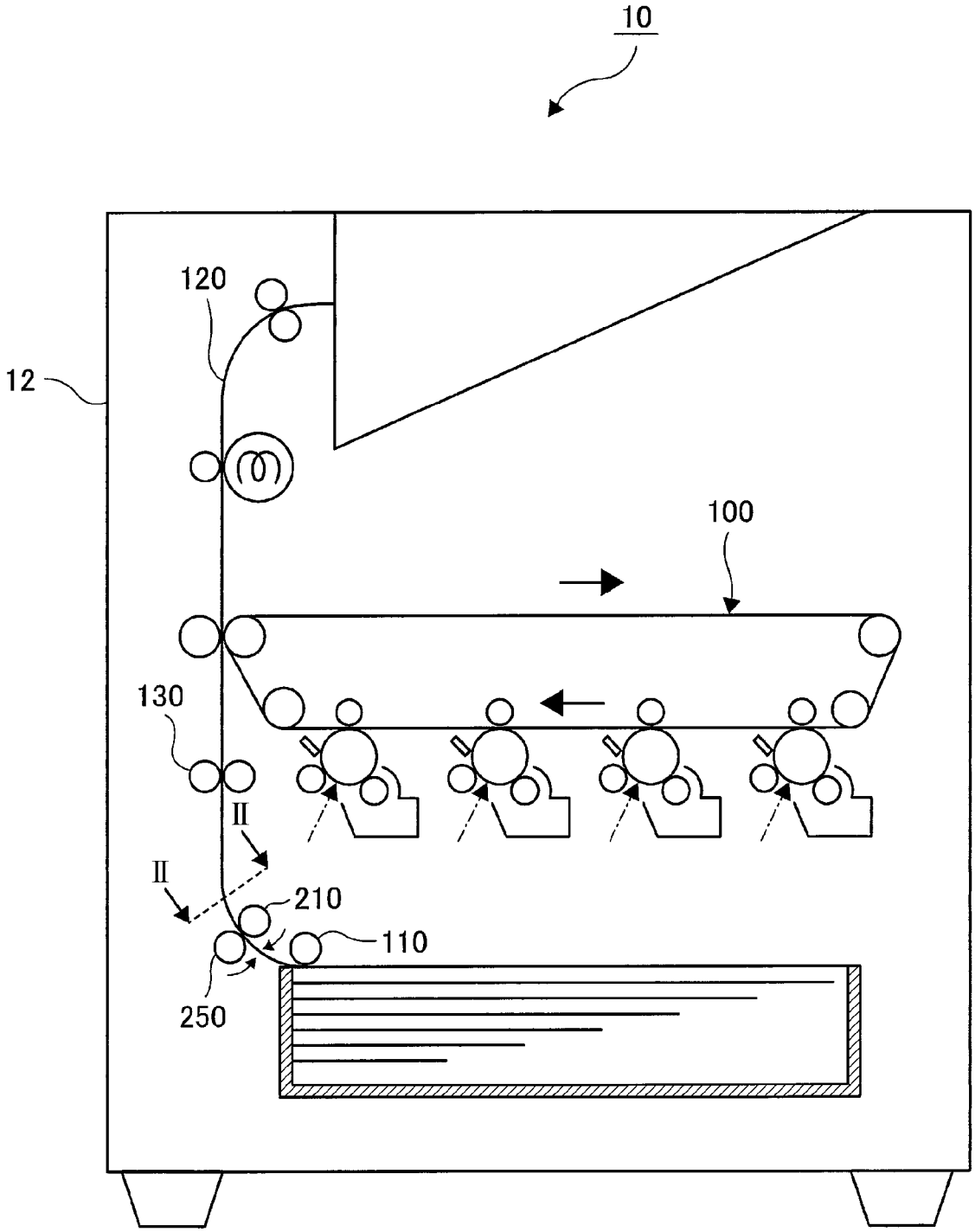
FIG. 1 is a cross-sectional view from a front surface of an image forming apparatus according to an exemplary embodiment of the present disclosure.

An exemplary embodiment for implementing the present disclosure is described below with reference to the drawings. FIG. 1 illustrates an image forming apparatus 10 according to an exemplary embodiment of the present disclosure. The image forming apparatus 10 is an example of an image forming apparatus described in the claims, and is an example of a transport device described in the claims.

As illustrated in FIG. 1, the image forming apparatus 10 includes an image forming apparatus body 12. An image forming unit 100 is arranged in the image forming apparatus body 12. The image forming unit 100 employs electrophotographic system, and forms a multicolor image using toners of yellow, magenta, cyan, and black. The image forming unit 100 may employ another system, for example, ink-jet system instead of employing electrophotographic system. The image forming unit 100 may form an image of a single color, for example, a black color instead of forming a multicolor image.

In addition, a paper feed device 110 is arranged in the image forming apparatus body 12. The paper feed device 110 feeds a sheet of paper, which is an example of a recording medium and which is an example of an object to be transported, to the image forming unit 100.

A transport path 120 is formed in the image forming apparatus body 12. A sheet fed from the paper feed device 110 is transported to the image forming unit 100 through the transport path 120 and the sheet on which an image has been formed by the image forming unit 100 is further transported through the transport path 120 to the outside of the image forming apparatus body 12.

A registration roller 130 is arranged at a position that is along the transport path 120 and that is located upstream of the image forming unit 100 in a sheet transport direction. The registration roller 130 temporarily stops movement of a leading end portion of the sheet and resumes the movement of the leading end portion of the sheet to coincide with image formation by the image forming unit 100. The registration roller 130 also reduces skew of the sheet.

A driving roller 210 is arranged at a position that is along the transport path 120 and that is located upstream of the registration roller 130 in the sheet transport direction. The driving roller 210 is an example of a first rotary part. The details of the driving roller 210 will be described later.

A driven roller 250 is arranged in the image forming apparatus body 12 so as to contact the driving roller 210 with the transport path 120 interposed therebetween. The driven roller 250 is an example of a second rotary part. The details of the driven roller 250 will be described later.

Figure 2:
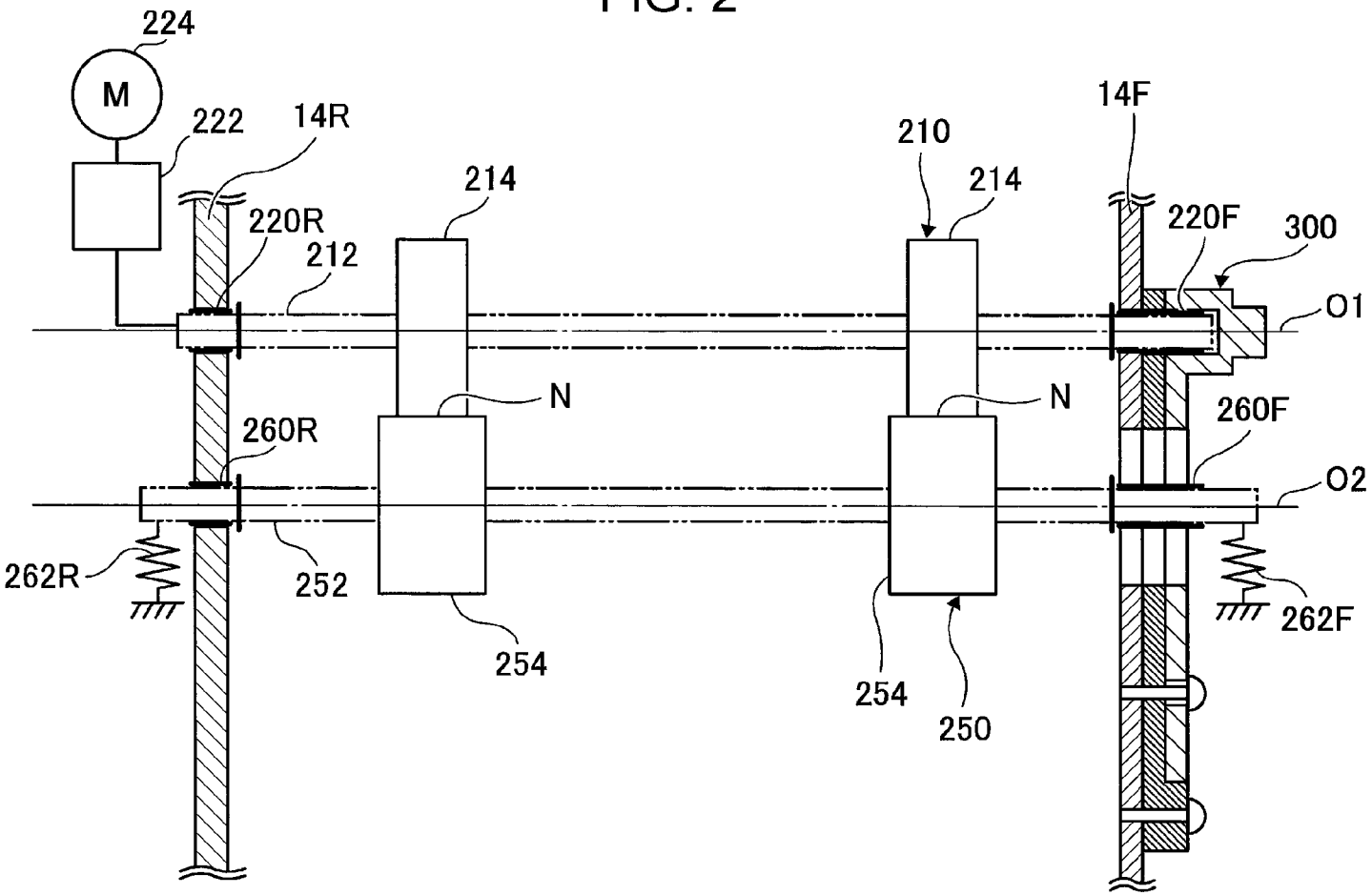
FIG. 2 illustrates a driving roller and a driven roller viewed in arrow II-II direction in FIG. 1.

FIG. 2 illustrates the driving roller 210, the driven roller 250, and configurations close to the driving roller 210 and the driven roller 250 viewed in arrow II-II direction in FIG. 1. As illustrated in FIG. 2, the driving roller 210 includes a shaft member 212 and, for example, plural roller portions 214. The roller portions 214 are fixed to the shaft member 212. The material of surfaces of the roller portions 214 is, for example, rubber.

The driving roller 210 is supported rotatably relative to a body frame 14F and a body frame 14R by using a bearing 220F attached to a front side and a bearing 220R attached to a rear side. In this case, the front side is an example of one end portion side of the driving roller 210, and the rear side is an example of the other end portion side of the driving roller 210. In addition, a motor 224 that is an example of a drive source is coupled to the driving roller 210 via a drive transmission mechanism 222 that includes, for example, plural gears. When drive is transmitted from the motor 224 to the driving roller 210, the driving roller 210 rotates in an arrow direction illustrated in FIG. 1 around a rotation center O1.

The driven roller 250 contacts the driving roller 210 and forms a nip N between the driven roller 250 and the driving roller 210. The nip N is an example of a pinch region, and the sheet is pinched at the nip N. The driven roller 250 includes a shaft member 252 and, for example, plural roller portions 254. The plural roller portions 254 are fixed to the shaft member 252. The material of surfaces of the roller portions 254 is, for example, resin.

A bearing 260F is attached to a front side of the driven roller 250 and a bearing 260R is attached to a rear side of the driven roller 250. The driven roller 250 is supported rotatably in an arrow direction illustrated in FIG. 1 around a rotation center O2 by the bearing 260F and the bearing 260R. In this case, the front side is an example of one end portion side of the driven roller 250, and the rear side is an example of the other end portion side of the driven roller 250.

The bearing 260R is supported by the body frame 14R. The bearing 260R and the driven roller 250 are able to swing relative to the body frame 14R around the position at which the body frame 14R supports the bearing 260R. The bearing 260F is supported by a positioning mechanism 300. The positioning mechanism 300 is a mechanism that positions the driven roller 250 with respect to the driving roller 210, and that further adjusts the position of the driven roller 250 with respect to the driving roller 210. The details of the positioning mechanism 300 will be described later.

The driven roller 250 is urged toward the driving roller 210 so as to be pressed against the driving roller 210 by a coil spring 262F and a coil spring 262R. The coil spring 262F and the coil spring 262R are examples of an urging section.

Figure 3:
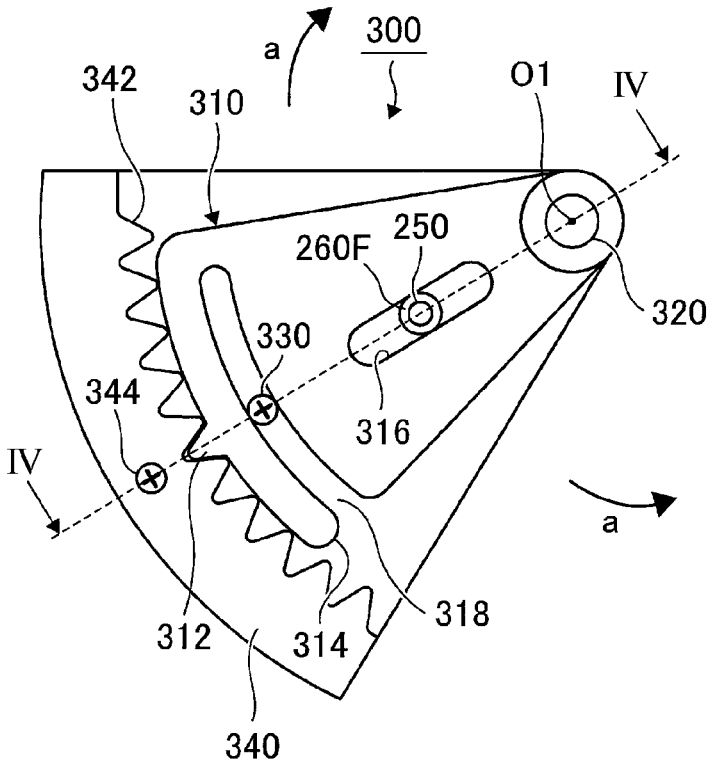
FIG. 3 illustrates a positioning mechanism viewed from a front surface side.
Figure 4:
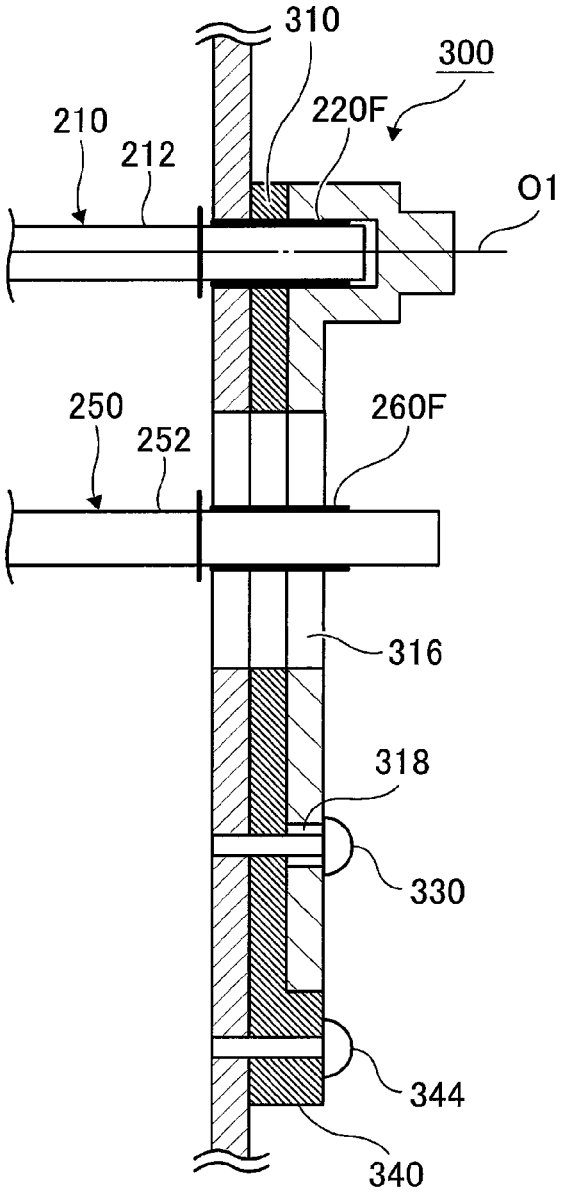
FIG. 4 illustrates a cross section of the positioning mechanism taken along line IV-IV in FIG. 3.

FIG. 3 illustrates the positioning mechanism 300 viewed from a front side. FIG. 4 illustrates a cross section of the positioning mechanism 300 taken along line IV-IV in FIG. 3. As illustrated in FIGS. 3 and 4, the positioning mechanism 300 includes a swing part 310.

The swing part 310 supports the front side of the driven roller 250. More specifically, the swing part 310 supports the driven roller 250 via the bearing 260F attached to the shaft member 252 of the driven roller 250. Moreover, the swing part 310 is supported by a front side of the driving roller 210, and is swingable in a direction indicated by arrow a in FIG. 3 around the rotation center O1 of the driving roller 210. More specifically, the swing part 310 is swingable around the rotation center O1 because the swing part 310 is rotatably supported on an outer peripheral surface of the bearing 220F.

The swing part 310 has, for example, a single tooth 312 formed so as to protrude toward a swing adjusting part 340 (described later). The tooth 312 is an example of a meshing portion and meshes with a tooth row 342 (described later).

The swing part 310 further includes an arm portion 314. The arm portion 314 is an example of a deforming portion and is elastically deformable in a direction in which the tooth 312 moves away from the tooth row 342 (described later).

The swing part 310 also has a long hole 316. The long hole 316 is an example of a support portion, and supports the front side of the driven roller 250 to allow the driven roller 250 to move in a direction in which the driven roller 250 moves toward the driving roller 210 and a direction in which the driven roller 250 moves away from the driving roller 210.

The swing part 310 has a groove 318 so as to allow one end portion to be open.

The swing part 310 includes an attachment portion 320. An operation tool (not illustrated) that rotates the swing part 310, for example, a screwdriver is attached to the attachment portion 320. Alternatively, instead of rotating the swing part by attaching the operation tool to the attachment portion 320 and operating the operation tool, an operator may directly hold the swing part 310 and rotate the holding swing part 310.

The positioning mechanism 300 further has a screw 330. The screw 330 is an example of a fixing section that fixes the swing part 310, is attached so as to pass through the groove 318, and fixes the swing part 310 to the body frame 14F.

The positioning mechanism 300 further includes the swing adjusting part 340. The swing adjusting part 340 adjusts an amount by which the swing part 310 swings (the position of the swing part 310). A tooth row 342 that constitutes a gear is formed at the swing adjusting part 340 on the side of the swing part 310. The tooth row 342 is an example of a meshed portion and is meshed with the tooth 312 of the swing part 310. The swing adjusting part 340 is fixed to the body frame 14F by using a screw 344.

Since the swing adjusting part 340 is provided and the tooth 312 of the swing part 310 meshes with the tooth row 342 of the swing adjusting part 340, the amount by which the swing part 310 swings is limited on the basis of the unit of the length between two adjacent teeth that constitute the tooth row. That is, the swing adjusting part 340 limits the movement of the swing part 310 such that the adjustment resolution meets the length between two adjacent teeth that constitute the tooth row. The length between two adjacent teeth that constitute the tooth row is, for example, 0.1 mm.

In the image forming apparatus 10 configured as described above, the position of the swing part 310 is temporarily determined, and hence the position of the driven roller 250 is temporarily determined with respect to the driving roller 210. Then, the position of the driven roller 250 with respect to the driving roller 210 is adjusted by using the positioning mechanism 300, and the driven roller 250 is finally positioned with respect to the driving roller 210.

To finally position the driven roller 250 with respect to the driving roller 210, the screw 330 is removed first. By removing the screw 330, the fixture of the swing part 310 to the body frame 14F is relaxed, the swing part 310 becomes swingable, the arm portion 314 no longer contacts the screw 330, and the arm portion 314 becomes elastically deformable.

Then, when the operation tool is attached to the attachment portion 320 and the operator operates the operation tool, the swing part 310 swings so as to rotate around the rotation center O1. At this time, the arm portion 314 is elastically deformed in a direction in which the tooth 312 moves away from the tooth row 342 and in which the groove 318 is narrowed. Thus, the swing part 310 is able to swing even though the swing adjusting part 340 located at a position at which the swing adjusting part 340 interferes with the locus of the movement of the swing part 310 is not removed.

When the driven roller 250 has moved to a desirable position, the swing part 310 is fixed again to the body frame 14F by using the screw 330, and the positioning of the driven roller 250 with respect to the driving roller 210 is completed.

In the image forming apparatus 10 configured as described above, if a transport failure occurs on a sheet pinched at the nip N, the urging of the driven roller 250 by the coil spring 262F and the coil spring 262R is relaxed. Since the urging of the driven roller 250 is relaxed, the front side of the driven roller 250 becomes movable in the direction away from the driving roller 210 while being guided by the long hole 316, thereby opening the nip N. Thus, the sheet with the transport failure at the nip N is easily removed as compared with a case where the nip N is not opened.

Figure 5:
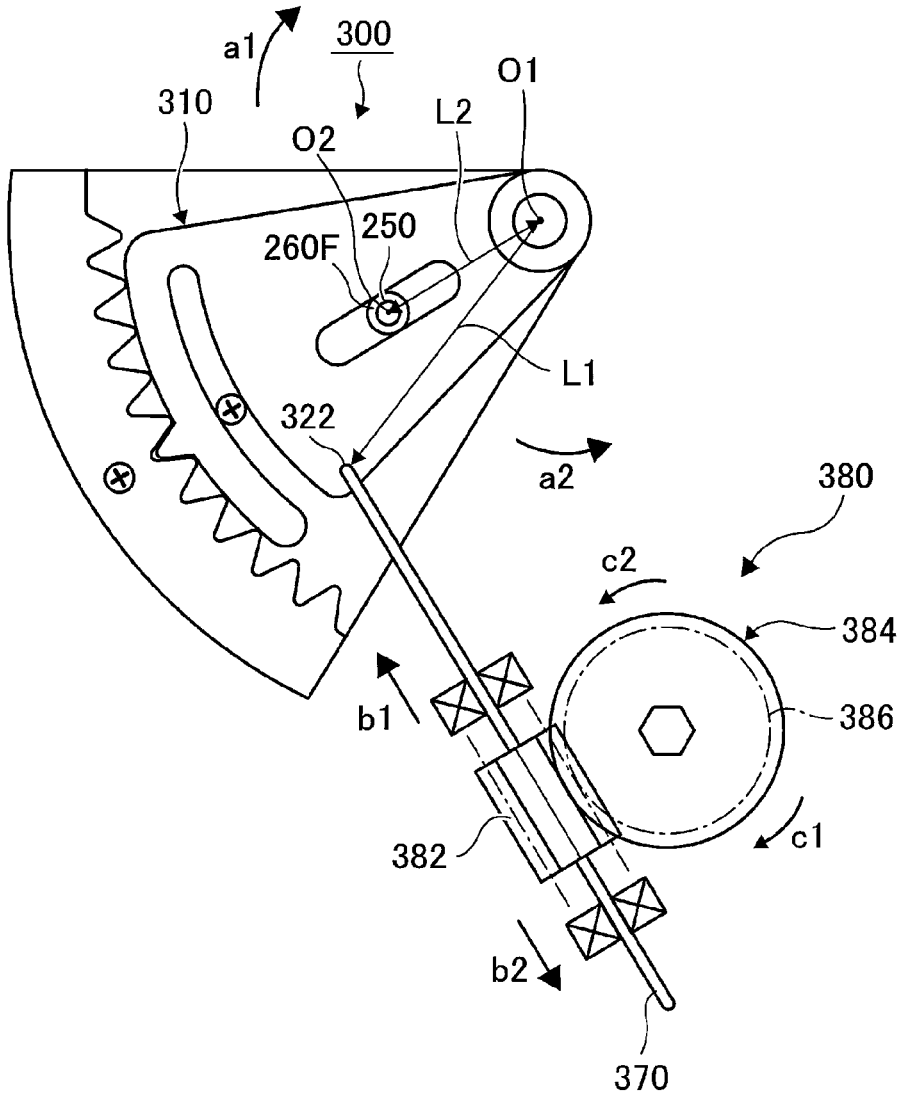
FIG. 5 illustrates a first modification of the positioning mechanism viewed from a front surface side.

FIG. 5 illustrates a first modification of the positioning mechanism 300 viewed from a front surface side. As illustrated in FIG. 5, the positioning mechanism 300 of the first modification has a coupling part 370 in addition to the configuration of the positioning mechanism 300 according to the above-described exemplary embodiment. The coupling part 370 moves so as to swing the swing part 310, and is coupled to the swing part 310 at a coupling position 322.

The coupling part 370 is provided with a moving mechanism 380 that moves the coupling part 370. The moving mechanism 380 includes, for example, a worm gear 382 attached to the coupling part 370, and an operation plate 384 having a gear row 386 that meshes with the worm gear 382.

In the first modification, when the operator rotates the operation plate 384 in a direction indicated by arrow c1 illustrated in FIG. 5, the coupling part 370 moves in a direction indicated by arrow b1 illustrated in FIG. 5; and when the coupling part 370 moves in the direction indicated by arrow b1, the swing part 310 swings in a direction indicated by arrow a1 in FIG. 5. When the operator rotates the operation plate 384 in a direction indicated by arrow c2 illustrated in FIG. 5, the coupling part 370 moves in a direction indicated by arrow b2 illustrated in FIG. 5; and when the coupling part 370 moves in the direction indicated by arrow b2, the swing part 310 swings in a direction indicated by arrow a2 in FIG. 5.

In the first modification, a length L1 from the rotation center O1 of the swing part 310 to the coupling position 322 is larger than a length L2 from the rotation center O1 to the rotation center O2 of the driven roller 250.

Figure 6:
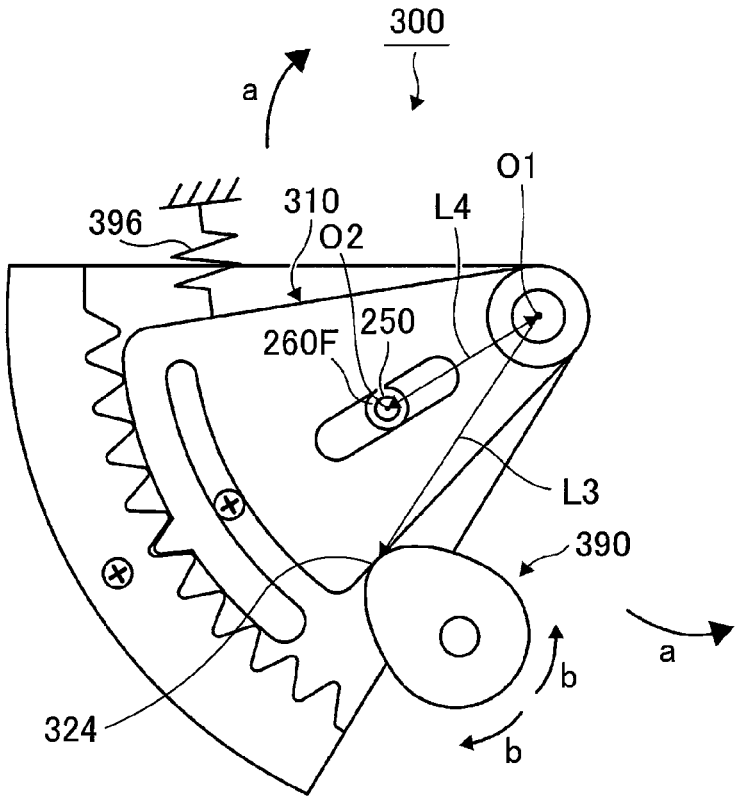
FIG. 6 illustrates a second modification of the positioning mechanism viewed from a front surface side.

FIG. 6 illustrates a second modification of the positioning mechanism 300 viewed from a front surface side. As illustrated in FIG. 6, the positioning mechanism 300 of the second modification has a cam part 390 in addition to the configuration of the positioning mechanism 300 according to the above-described exemplary embodiment. The cam part 390 contacts the swing part 310 at a contact position 324.

The second modification of the positioning mechanism 300 includes a coil spring 396 as an example of an urging section, the swing part 310 is urged by the coil spring 396, and the swing part 310 is pressed against the cam part 390. In the second modification, when the operator rotates the cam part 390 in a direction indicated by arrows b illustrated in FIG. 6, the swing part 310 swings in a direction indicated by arrows a illustrated in FIG. 6.

In the second modification, a length L3 from the rotation center O1 of the swing part 310 to the contact position 324 is larger than a length L4 from the rotation center O1 to the rotation center O2 of the driven roller 250.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transport device comprising:

a first rotary part that rotates;

a second rotary part that contacts the first rotary part, that forms a pinch region where an object to be transported is pinched between the second rotary part and the first rotary part, and that rotates together with the first rotary part; and a positioning mechanism that positions the second rotary part with respect to the first rotary part, wherein the positioning mechanism includes a swing part that supports one end portion side of the second rotary part, that is supported at one end portion side of the first rotary part, and that is swingable around a rotation center of the first rotary part;

a fixing section that fixes the swing part; and a swing adjusting part that has a meshed portion configured to be meshed with a meshing portion formed at the swing part and that adjusts an amount by which the swing part swings, wherein the swing part has a deforming portion that is elastically deformable in a direction in which the meshing portion moves away from the meshed portion.

2. The transport device according to claim 1, further comprising:

a bearing that rotatably supports the one end portion side of the first rotary part, wherein the swing part is rotatably supported on an outer peripheral surface of the bearing.

3. The transport device according to claim 1, further comprising:

an urging section that urges the second rotary part toward the first rotary part such that the second rotary part is pressed against the first rotary part, wherein the swing part has a support portion that supports the one end portion side of the second rotary part movably in a direction toward the first rotary part and a direction away from the first rotary part.

4. The transport device according to claim 1, wherein the positioning mechanism further includes a coupling part that moves the swing part so as to swing the swing part and that is coupled to the swing part at a coupling position.

5. The transport device according to claim 4, wherein a length from a rotation center of the swing part to the coupling position is larger than a length from the rotation center of the swing part to a rotation center of the second rotary part.

6. The transport device according to claim 1, further comprising:

a cam part that rotates so as to swing the swing part and that contacts the swing part at a contact position, wherein a length from a rotation center of the swing part to the contact position is larger than a length from the rotation center of the swing part to a rotation center of the second rotary part.

7. The transport device according to claim 1, wherein the swing part comprises a groove that is formed between the rotation center of the first rotary part and the meshing portion.

8. An image forming apparatus comprising:

an image forming unit that forms an image on a recording medium; and a transport device that transports one of a recording medium on which an image is to be formed by the image forming unit and a recording medium on which an image has been formed by the image forming unit, wherein the transport device includes a first rotary part that rotates, a second rotary part that contacts the first rotary part, that forms a pinch region where the recording medium is pinched between the second rotary part and the first rotary part, and that rotates together with the first rotary part, and a positioning mechanism that positions the second rotary part with respect to the first rotary part, and wherein the positioning mechanism includes a swing part that supports one end portion side of the second rotary part, that is supported at one end portion side of the first rotary part, and that is swingable around a rotation center of the first rotary part;

a fixing section that fixes the swing part; and a swing adjusting part that has a meshed portion configured to be meshed with a meshing portion formed at the swing part and that adjusts an amount by which the swing part swings, wherein the swing part has a deforming portion that is elastically deformable in a direction in which the meshing portion moves away from the meshed portion.

* * * * *